US010724321B2

(12) United States Patent
Leonard et al.

(10) Patent No.: US 10,724,321 B2
(45) Date of Patent: Jul. 28, 2020

(54) DOWNHOLE TOOLS WITH CONTROLLED DISINTEGRATION

(71) Applicants: Zachary Serpas Leonard, Magnolia, TX (US); John Wakefield, Cypress, TX (US)

(72) Inventors: Zachary Serpas Leonard, Magnolia, TX (US); John Wakefield, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 122 days.

(21) Appl. No.: 15/727,680

(22) Filed: Oct. 9, 2017

(65) Prior Publication Data

US 2019/0106959 A1 Apr. 11, 2019

(51) Int. Cl.

| | |
|---|---|
| ***E21B 29/02*** | (2006.01) |
| ***E21B 33/12*** | (2006.01) |
| ***C22C 30/00*** | (2006.01) |
| ***C22C 21/00*** | (2006.01) |
| ***C22C 22/00*** | (2006.01) |
| ***C22C 5/04*** | (2006.01) |
| ***E21B 34/14*** | (2006.01) |
| ***E21B 33/134*** | (2006.01) |

(52) U.S. Cl.

CPC ..... *E21B 29/02* (2013.01); *C22C 5/04* (2013.01); *C22C 21/00* (2013.01); *C22C 22/00* (2013.01); *C22C 30/00* (2013.01); *E21B 33/12* (2013.01); *E21B 33/1208* (2013.01); *E21B 33/134* (2013.01); *E21B 34/14* (2013.01)

(58) Field of Classification Search

CPC ..... E21B 29/02; E21B 33/1208; C22C 5/04; C22C 21/00; C22C 22/00; C22C 30/00

See application file for complete search history.

(56) References Cited

U.S. PATENT DOCUMENTS

| | | | | |
|---|---|---|---|---|
| 8,528,633 | B2 | 9/2013 | Agrawal et al. | |
| 8,573,295 | B2 | 11/2013 | Johnson et al. | |
| 9,079,246 | B2 | 7/2015 | Xu et al. | |
| 9,101,978 | B2 | 8/2015 | Xu et al. | |
| 2012/0318513 | A1 | 12/2012 | Mazyar et al. | |
| 2013/0146302 | A1 | 6/2013 | Gaudette et al. | |
| 2017/0314359 | A1* | 11/2017 | Fripp | E21B 33/1208 |
| 2018/0283142 | A1* | 10/2018 | Zhang | E21B 41/0085 |

OTHER PUBLICATIONS

"Pyrotechnic initiator", Wikipedia, Retrieved via Internet Feb. 5, 2019 [https://en.wikipedia.org/wiki/Pyrotechnic_initiator], webpage was last edited on May 24, 2018 (4 pages).

* cited by examiner

*Primary Examiner* — David J Bagnell
*Assistant Examiner* — Yanick A Akaragwe
(74) *Attorney, Agent, or Firm* — Cantor Colburn LLP

(57) ABSTRACT

A disintegrable downhole article comprises an electrolytically degradable metallic matrix and an energetic material comprising a first metal and a second metal that is in physical contact with the first metal. The first metal and the second metal are selected such that the first metal reacts with the second metal to generate an alloy, an intermetallic compound, heat, or a combination comprising at least one of the foregoing when electrically actuated. A method of controllably removing a disintegrable downhole article comprises disposing the downhole article in a downhole environment; performing a downhole operation; electrically actuating the energetic material; and disintegrating the downhole article.

25 Claims, 2 Drawing Sheets

DOWNHOLE TOOLS WITH CONTROLLED DISINTEGRATION

BACKGROUND

Oil and natural gas wells often utilize wellbore articles that, due to their function, are only required to have limited service lives that are considerably less than the service life of the well. After an article service function is complete, it must be removed or disposed of in order to recover the original size of the fluid pathway for use, including hydrocarbon production, $CO_2$ sequestration, etc.

To facilitate their removal, such articles may be formed of a material that reacts with a downhole fluid so that the articles need not be physically removed by milling or drilling, but may instead corrode or disintegrate under downhole conditions. To maintain the mechanical strength and the structural integrity of the articles during service, the articles normally have a slow corrosion rate. However, when the tool functionality is complete, such a slow disintegration rate is no longer desirable because the sooner the articles disintegrate, the quicker the well can be put on production. Therefore, the development of articles that have the mechanical properties necessary to perform their intended function and then rapidly disintegrate is very desirable.

SUMMARY

A disintegrable downhole article comprises an electrolytically degradable metallic matrix; and an energetic material comprising a first metal and a second metal that is in physical contact with the first metal, the first metal and the second metal being selected such that the first metal reacts with the second metal to generate an alloy, an intermetallic compound, heat, or a combination comprising at least one of the foregoing when electrically actuated.

In another embodiment, a disintegrable downhole article comprises a substantially-continuous, cellular nanomatrix comprising a nanomatrix material; a plurality of dispersed particles comprising a first metal dispersed in the cellular nanomatrix; and a second metal dispersed in the cellular nanomatrix, in the dispersed particles comprising the first metal, or a combination thereof, wherein the first metal and the second metal are in physical contact and are selected such that the first metal reacts with the second metal to generate an alloy, an intermetallic compound, heat, or a combination comprising at least one of the foregoing when electrically actuated.

Also disclosed is a downhole assembly comprising the above-described disintegrable downhole article and an electric current source electrically coupled to the disintegrable article.

A method of controllably removing a disintegrable downhole article comprises disposing the above-described downhole article in a downhole environment; performing a downhole operation; electrically actuating a reaction between the first metal and the second metal; and disintegrating the downhole article.

BRIEF DESCRIPTION OF THE DRAWINGS

The following descriptions should not be considered limiting in any way. With reference to the accompanying drawings, like elements are numbered alike.

DETAILED DESCRIPTION

The disclosure provides downhole disintegrable articles that have minimized disintegration rate when the articles are in service but can rapidly disintegrate in response to an electrical pulse signal when the articles are no longer needed.

The disintegrable articles include a first metal and a second metal that is in physical contact with the first metal. The first metal and the second metal are selected such that the first metal reacts with the second metal to generate an alloy, an intermetallic compound, heat, or a combination comprising at least one of the foregoing when electrically actuated. Exemplary first metal includes aluminum, magnesium, an aluminum alloy, a magnesium alloy, or a combination comprising at least one of the foregoing. Exemplary second metal includes palladium, platinum, a palladium alloy, a platinum alloy, or a combination comprising at least one of the foregoing. Use of first and second metals as disclosed herein is advantageous as these materials are stable at wellbore temperatures but produce an extremely intense exothermic reaction following activation, which facilitates the rapid disintegration of the disintegrable articles.

Figure 1:
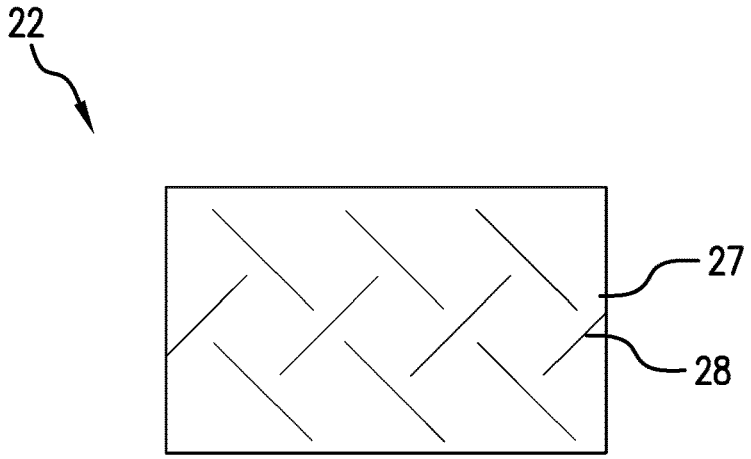
FIG. 1 illustrates an exemplary disintegrable article having wires dispersed in an electrolytically degradable metal composite matrix, where the wires comprise a first metal and a second metal that is reactive with the first metal upon electrical actuation.
Figure 2:
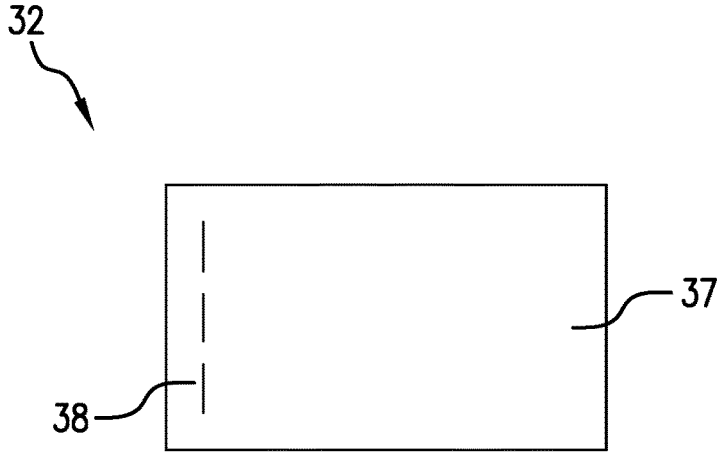
FIG. 2 illustrates an exemplary disintegrable article having wires comprising a first metal and a second metal that is reactive with the first metal upon electrical actuation, where the wires are positioned proximate a surface of the disintegrable article.
Figure 3:
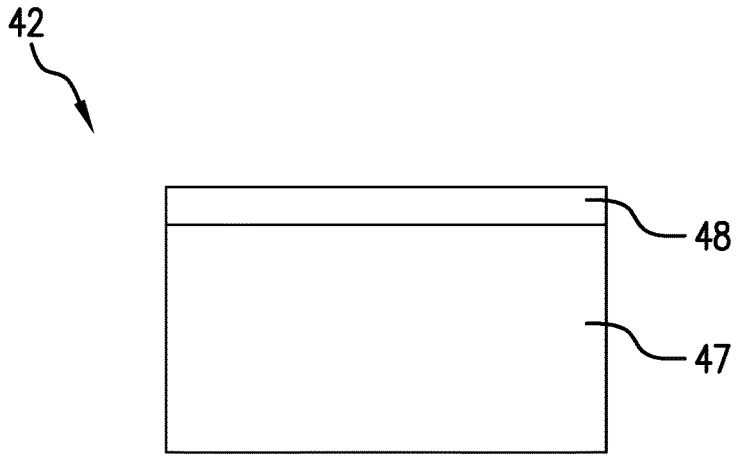
FIG. 3 illustrates an exemplary disintegrable article having a coating disposed on a substrate of the disintegrable article, wherein the coating comprises a first metal and a second metal that is reactive with the first metal upon electrical actuation.

The structures of the exemplary disintegrable articles according to various embodiments of the disclosure are illustrated in FIGS. 1-4. Referring to FIGS. 1-3, the disintegrable article (22, 32, and 42) includes an electrolytically degradable metallic matrix (27, 37, and 47) and an energetic material (28, 38, and 48).

The energetic material comprises the first metal and the second metal as described herein. In an embodiment (not shown), the energetic material includes an aluminum or aluminum alloy core with a palladium outer jacket. Optionally the palladium outer jacket contains ruthenium in addition to palladium, for example about 1 to about 10 wt. % of ruthenium based on the total weight of the palladium outer jacket. An exemplary energetic material is commercially available as PYROFUZE. The energetic material can be in the form of wires, short fibers, ribbons, particles, pellets, or a combination comprising at least one of the foregoing. The energetic material can also be in the form of a coating.

As shown in FIG. 1, the energetic material (28) can be randomly distributed in the electrolytically degradable metallic matrix (27). Alternatively as shown in FIG. 2, the energetic material (38) is disposed in electrolytically degradable metallic matrix (37) and proximate a surface of the disintegrable article (32). The energetic material (48) can also form a coating disposed on a surface of the disintegrable article (42) as illustrated in FIG. 3.

The amount of the energetic material is not particularly limited and is generally an amount sufficient to generate enough heat to facilitate the rapid disintegration of the downhole articles once it is activated. In an embodiment, the energetic metal is present in an amount of about 0.5 wt. % to about 45 wt. % or about 0.5 wt. % to about 20 wt. % based on the total weight of the disintegrable article.

As used herein, an electrolytically degradable metallic matrix refers to a matrix that can degrade in a galvanic discharge cycle in the presence of an electrolyte. The matrix comprises a relatively more reactive material and a relatively less reactive material. In the presence of an electrolyte, the relatively more reactive material loses electrons to the relatively less reactive material and forms cations. The formed cations can dissolve in the electrolyte thus electrolytically degrading the metallic matrix.

In an embodiment, the electrolytically degradable metallic matrix comprises a matrix material which includes Zn, Mg, Al, Mn, an alloy thereof, or a combination comprising at least one of the foregoing. The electrolytically degradable metallic matrix can further comprise a corrosion reinforcement agent such as Al, Ni, W, Mo, Cu, Fe, Cr, Co, Sr, Ga, In, Zr, Y, Ca, Ag, Ce, La, Gd, Pb, Sn, Zn, Nd, Cd, an alloy thereof, or a combination comprising at least one of the foregoing.

The corrosion reinforcement agent, which has a lower reactivity relative to the matrix material, acts as a cathode, whereas the matrix material, which is selected to be more reactive than the corrosion reinforcement agent, acts as an anode. A galvanic discharge cycle (e.g., corrosion) occurs between the relatively anodic and relatively cathodic materials in the presence of an electrolyte. By adjusting the compositions of the matrix material and the corrosion reinforcement agent and the amount of the corrosion reinforcement agent relative to the matrix material, the corrosion rate of the metallic matrix can be adjusted.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include those prepared from magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys. In an embodiment, the magnesium alloy comprises greater than zero percent but less than or equal to about 1 wt. % of nickel, specifically less than or equal to about 0.5 wt. % of nickel, more specifically less than or equal to about 0.4 wt. % of nickel, and even more specifically less than or equal to about 0.3 wt. % of nickel.

In an embodiment the electrolytically degradable metallic matrix is a metal composite having a substantially-continuous, cellular nanomatrix comprising a nanomatrix material; and a plurality of dispersed particles comprising a particle core material that comprises Mg, Al, Zn or Mn, or a combination thereof, dispersed in the cellular nanomatrix. The metal composite can also include a solid-state bond layer extending throughout the cellular nanomatrix between the dispersed particles. The nanomatrix material comprises Al, Zn, Mn, Mg, Mo, W, Cu, Fe, Si, Ca, Cr, Co, Ta, Re or Ni, or an oxide, carbide or nitride thereof, or a combination of any of the aforementioned materials. The chemical composition of the nanomatrix material is different than the chemical composition of the dispersed particles. In an embodiment, a difference between the standard oxidization potential of the nanomatrix material and the standard oxidization potential of the chemical composition of the dispersed particles is about 0.7 to about 2.7 volts. The volume ratio of the continuous, cellular nanomatrix relative to the plurality of dispersed particles can be about 1:100 to about 1:1 or about 1:80 to about 1:10. As used herein, "substantially-continuous" describes the extension of the nanomatrix material throughout the metal composite such that it extends between and envelopes substantially all of the dispersed particles. Substantially-continuous is used to indicate that complete continuity and regular order of the nanomatrix around each dispersed particle is not required. For example, defects in the coating layer over particle core on some powder particles may cause bridging of the particle cores during sintering of the metal composite, thereby causing localized discontinuities to result within the cellular nanomatrix, even though in the other portions of the powder compact the nanomatrix is substantially continuous.

The matrix can be formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 50 to about 150 micrometers, and specifically about 5 to about 300 micrometers, or about 60 to about 140 micrometers. Such metal composites are referred to herein as controlled electrolytic materials (CEM). The CEM materials have been described in U.S. Pat. Nos. 8,528,633 and 9,101,978.

Optionally, the electrolytically degradable metallic matrix further comprises additives such as carbides, nitrides, oxides, precipitates, dispersoids, glasses, carbons, or the like in order to control the mechanical strength and density of the disintegrable article.

Figure 4:
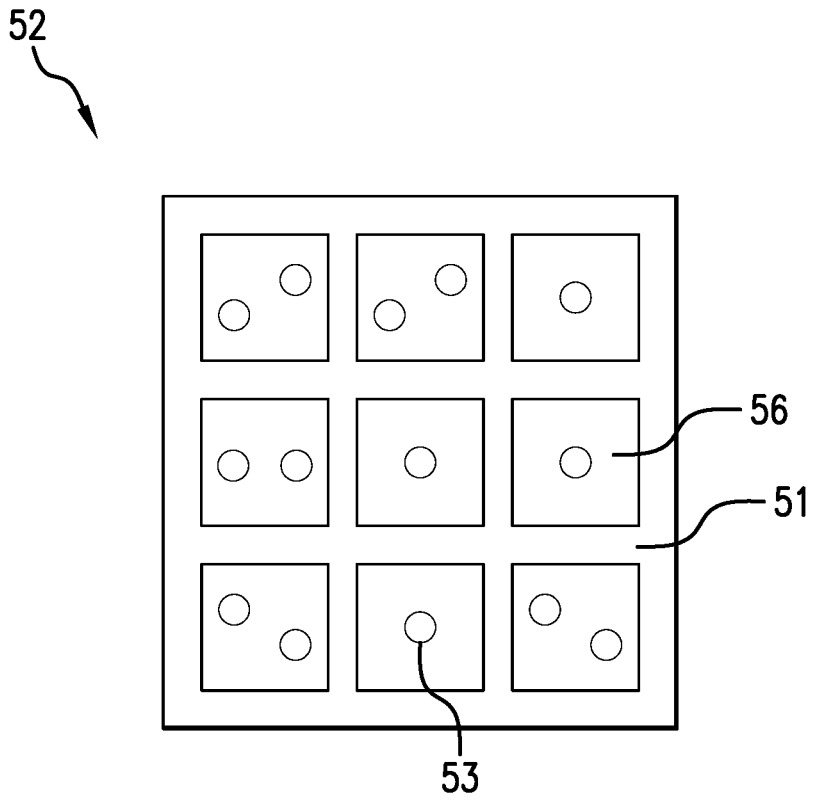
FIG. 4 illustrates an exemplary disintegrable article having a second metal disposed in particles of a first metal, in a cellular nanomatrix surrounding the particles of the first metal, or a combination thereof.

Turning to FIG. 4, disintegrable article 52 includes a plurality of particles 56 dispersed in a substantially-continuous, cellular nanomatrix 51, which contains a cellular nanomatrix material. The dispersed particles 56 comprise the first metal, in particular, magnesium, aluminum, a magnesium alloy, an aluminum alloy, or a combination comprising at least one of the foregoing. The magnesium alloy can be the same as the magnesium alloy described herein in the context of electrolytically degradable metallic matrix. The cellular nanomatrix comprises Al, Zn, Mn, Mo, W, Cu, Fe, Si, Ca, Co, Ta, Re or Ni, or an oxide, carbide or nitride thereof, or a combination of any of the aforementioned materials. Second metal 53 is in physical contact with the first metal and can be dispersed in particles 56, the cellular nanomatrix 51, or a combination thereof. The second metal is present in an amount of about 0.5 wt. % to about 45 wt. %, based on the total weight of the disintegrable article. The volume ratio of the substantially-continuous, cellular nanomatrix 51 relative to the dispersed particles 56 can be about 1:100 to about 1:1 or about 1:80 to about 1:10.

As a specific example, the disintegrable article includes a plurality of magnesium or magnesium alloy particles dispersed in a substantially-continuous cellular nanomatrix containing Al, Ni, W, Mo, Cu, Fe, Cr, Co, or a combination of any of the aforementioned materials. The disintegrable article further contains palladium or platinum dispersed in the magnesium or magnesium alloy particles.

As another specific embodiment, the disintegrable article includes a plurality of magnesium or magnesium alloy particles dispersed in a substantially-continuous cellular nanomatrix containing Al, Pd or Pt, and optionally Ni, W, Mo, Cu, Fe, Cr, Co, or a combination of any of the aforementioned materials, wherein Al is in physical contact with Pd and/or Pt.

The disintegrable article can also include a plurality of aluminum or aluminum alloy particles dispersed in a substantially-continuous cellular nanomatrix containing Ni, W, Mo, Cu, Fe, Cr, Co, or a combination of any of the aforementioned materials. The disintegrable article further contains palladium and/or platinum dispersed in the aluminum or aluminum alloy particles.

Further the disintegrable article can include a plurality of aluminum or aluminum alloy particles dispersed in a substantially-continuous cellular nanomatrix containing Pd or Pt, and one or more of Ni, W, Mo, Cu, Fe, Cr, or Co, wherein the Al is in physical contact with Pd and/or Pt.

Incorporating the second metal in the particles of the first metal can be carried out by blending the second metal with the first metal particles via any mechanical means. The second metal can also be deposited or coated on first metal particles using any suitable deposition method, such as, for example, chemical vapor deposition, physical vapor deposition, or electrical plating. The first metal particles can include a plurality of coating layers comprising a cellular nanomatrix material as described herein. After the cellular nanomatrix material and the second metal have been introduced to the first metal particles, the combination is sintered or molded at a temperature of less than 650° C. to provide the disintegrable article. During the process, the coating layers are joined by solid-state bonding to form the substantially-continuous, cellular nanomatrix and leave the particle cores as the dispersed particles.

The disintegrable articles disclosed herein can be controllably removed such that significant disintegration only occurs after these articles have completed their functions. A method of controllably removing a disintegrable article comprises disposing a disintegrable article as disclosed herein in a downhole environment; performing a downhole operation, which can be any operation that is performed during drilling, stimulation, completion, production, or remediation; electrically actuating a reaction between the first metal and the second metal in the disintegrable article; and disintegrating the downhole article.

Figure 5:
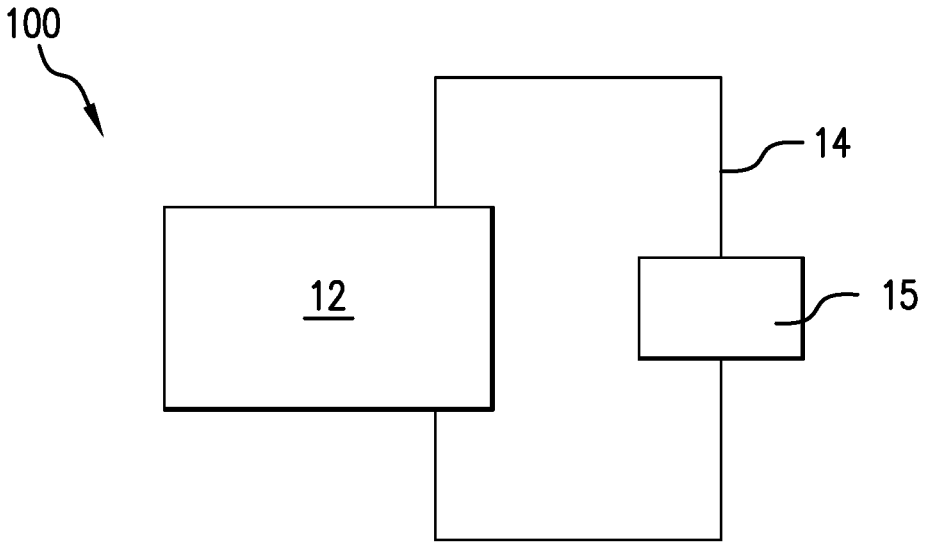
FIG. 5 illustrates an exemplary downhole assembly having a disintegrable article and an electrical current source electrically coupled to the disintegrable article.

FIG. 5 illustrates an exemplary downhole assembly (100) including a disintegrable article (12) and an electric current source (15) electrically coupled to the disintegrable article via wires (14). The electric current source 15 is effective to provide a current pulse to the disintegrable article 12. In an embodiment, the electric current source and the disintegrable article are coupled in an array pattern to enable the homogeneous supply of electric current to the surface of the disintegrable article. In other words, one or more current sources can be used to form two or more electric circuits with the disintegrable article. The electric current source can be a battery, a capacitor, a device effective to generate an electric current above the ground or in situ in a downhole environment, or a combination thereof. In an embodiment, the current source is a battery placed downhole or at the surface, and electrically connected to the disintegrable article.

The electrical current source can be controlled by a timer, a signal received above the surface, a signal generated downhole, or a combination comprising at least one of the foregoing. The signal is not particularly limited and includes electromagnetic radiation, an acoustic signal, pressure, or a combination comprising at least one of the foregoing.

When the signal is generated downhole, the article can further include a sensor that detects pressure, temperature, or the like in the local environment or stress or mechanical force applied to the disintegrable article. Pressure sensors may include quartz crystals or other piezoelectric materials. Temperature sensors may include electrodes configured to perform resistivity and capacitive measurements that may be converted to other useful data. Temperature sensors can also comprise a thermistor sensor including a thermistor material that changes resistivity in response to a change in temperature. The sensor may couple with a data processing unit. Such data processing unit includes electronics for obtaining and processing data of interest. The data processing unit can be located downhole or on the surface. Once a threshold value is satisfied, the sensor generates a signal which allows the electric current source to provide an electric current to the disintegrable article to actuate the reaction between the first metal and the second metal.

The electric current generates heat to initiate the reaction between the first metal and the second metal. The reaction can proceed to over 2000° C. until the first metal and/or the second metal is consumed. The generated heat can accelerate the disintegration of the downhole articles by thermal cracking, mechanical disintegration, or by accelerating electrolytic degradation and ion diffusion in a downhole fluid. Without wishing to be bound by theory, it is believed that the excess electrons provided by the current source can also accelerate the electrolytic degradation of the article by active transport of ions. The downhole fluid includes potassium chloride (KCl), hydrochloric acid (HCl), calcium chloride ($CaCl_2$)), calcium bromide ($CaBr_2$) or zinc bromide ($ZnBr_2$), or a combination comprising at least one of the foregoing.

Disintegrable articles in the downhole assembly are not particularly limited. Exemplary articles include a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, ICD plugs, a flapper valve, a gaslift valve, a transmatic valve CEM plug, float shoes, darts, diverter balls, shifting/setting balls, ball seats, sleeves, Teleperf disks, Direct Connect disks, drill-in liner disks, fluid loss control flappers, shear pins or screws, cementing plugs, Teleperf plugs, drill in sand control beaded screen plugs, HP beaded frac screen plugs, hold down dogs and springs, a seal bore protector, a stimcoat screen protector, or a liner port plug. In specific embodiments, the disintegrable article is a ball, a ball seat, a fracture plug, a whipstock, a cylinder, or a liner plug. A downhole assembly comprising the disintegrable article is also provided.

Set forth below are various embodiments of the disclosure.

Embodiment 1

A disintegrable downhole article comprising: an electrolytically degradable metallic matrix; and an energetic material comprising a first metal and a second metal that is in physical contact with the first metal, the first metal and the second metal being selected such that the first metal reacts with the second metal to generate an alloy, an intermetallic compound, heat, or a combination comprising at least one of the foregoing when electrically actuated.

Embodiment 2

The disintegrable downhole article as in any prior embodiment, wherein the electrolytically degradable metallic matrix comprises Zn, Mg, Al, Mn, an alloy thereof, or a combination comprising at least one of the foregoing. The electrolytically degradable metallic matrix can further comprise Ni, W, Mo, Cu, Fe, Cr, Co, Sr, Ga, In, Zr, Y, Ca, Ag, Ce, La, Gd, Pb, Sn, Zn, Nd, Cd, an alloy thereof, or a combination comprising at least one of the foregoing.

Embodiment 3

The disintegrable downhole article as in any prior embodiment, wherein the energetic material is present in an amount of about 0.5 wt. % to about 45 wt. % based on the total weight of the disintegrable downhole article.

Embodiment 4

The disintegrable downhole article as in any prior embodiment, wherein the energetic material comprises fibers, wires, ribbons, powders, pellets, or a combination comprising at least one of the foregoing.

Embodiment 5

The disintegrable downhole article as in any prior embodiment, wherein the energetic material is randomly distributed in the electrolytically degradable matrix. Alternatively, the energetic material is embedded proximate a surface of the disintegrable downhole article. The energetic material can also be disposed on a surface of the disintegrable downhole article.

Embodiment 6

A disintegrable downhole article comprising a substantially-continuous, cellular nanomatrix comprising a nanomatrix material; a plurality of dispersed particles comprising a first metal dispersed in the cellular nanomatrix; and a second metal disposed in the cellular nanomatrix, in the dispersed particles, or a combination thereof, wherein the first metal and the second metal are in physical contact and are selected such that the first metal reacts with the second metal to generate an alloy, an intermetallic compound, heat, or a combination comprising at least one of the foregoing when electrically actuated. The nanomatrix material comprises Zn, Mg, Mn, Al, Ni, W, Mo, Cu, Fe, Cr, Co, Sr, Ga, In, Zr, Y, Ca, Ag, Ce, La, Gd, Pb, Sn, Zn, Nd, Cd, an alloy thereof, or a combination comprising at least one of the foregoing. In an embodiment, the second metal is present in an amount of about 0.5 wt. % to about 45 wt. % based on the total weight of the disintegrable downhole article.

Embodiment 7

The disintegrable downhole article as in any prior embodiment, wherein the first metal is one or more of the following: aluminum, magnesium, an aluminum alloy, or a magnesium alloy; and the second metal is one or more of the following: palladium, platinum, a palladium alloy, or a platinum alloy.

Embodiment 8

The disintegrable downhole article as in any prior embodiment, wherein the disintegrable downhole article is a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, an ICD plug, a flapper valve, a gaslift valve, a transmatic valve CEM plug, float shoes, a dart, a diverter ball, a shifting/setting ball, a ball seat, a sleeve, a Teleperf disk, a Direct Connect disk, a drill-in liner disk, a fluid loss control flapper, a shear pin or screw, a cementing plug, a Teleperf plug, a drill in sand control beaded screen plug, a HP beaded frac screen plug, a hold down dog and spring, a seal bore protector, a stimcoat screen protector, or a liner port plug.

Embodiment 9

A downhole assembly comprising the disintegrable downhole article as in any prior embodiment and an electric current source electrically coupled to the disintegrable downhole article.

Embodiment 10

A method of controllably removing a disintegrable downhole article, the method comprising: disposing a downhole article as in any prior embodiment in a downhole environment; performing a downhole operation; electrically actuating a reaction between the first metal and the second metal; and disintegrating the downhole article.

Embodiment 11

The method as in any prior embodiment, wherein electrically actuating a reaction between the first metal and the second metal comprises applying an electrical current to the first metal and the second metal.

All ranges disclosed herein are inclusive of the endpoints, and the endpoints are independently combinable with each other. As used herein, "combination" is inclusive of blends, mixtures, alloys, reaction products, and the like. All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

What is claimed is:

1. A disintegrable downhole article comprising:

an electrolytically degradable metallic matrix; and an energetic material comprising a first metal and a second metal that is in physical contact with the first metal, the first metal and the second metal being selected such that the first metal reacts with the second metal to generate an alloy, an intermetallic compound, heat, or a combination comprising at least one of the foregoing when a current pulse is applied to the disintegrable downhole article, wherein the first metal is aluminum or an aluminum alloy, the second metal is palladium or a palladium alloy, and the energetic material has a core of the first metal with an outer jacket of the second metal.

2. The disintegrable downhole article of claim 1, wherein the electrolytically degradable metallic matrix comprises Zn, Mg, Al, Mn, an alloy thereof, or a combination comprising at least one of the foregoing.

3. The disintegrable downhole article of claim 2, wherein the electrolytically degradable metallic matrix further comprises Ni, W, Mo, Cu, Fe, Cr, Co, Sr, Ga, In, Zr, Y, Ca, Ag, Ce, La, Gd, Pb, Sn, Zn, Nd, Cd, an alloy thereof, or a combination comprising at least one of the foregoing.

4. The disintegrable downhole article of claim 1, wherein the energetic material is present in an amount of about 0.5 wt. % to about 45 wt. % based on the total weight of the disintegrable downhole article.

5. The disintegrable downhole article of claim 1, wherein the energetic material comprises fibers, wires, ribbons, powders, pellets, or a combination comprising at least one of the foregoing.

6. The disintegrable downhole article of claim 1, wherein the energetic material is embedded proximate a surface of the disintegrable downhole article.

7. The disintegrable article of claim 1, wherein the energetic material is disposed on a surface of the disintegrable downhole article.

8. The disintegrable article of claim 1, wherein the disintegrable downhole article is a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, an ICD plug, a flapper valve, a gaslift valve, a transmatic valve CEM plug, float shoes, a dart, a diverter ball, a shifting/setting ball, a ball seat, a sleeve, a Teleperf disk, a Direct Connect disk, a drill-in liner disk, a fluid loss control flapper, a shear pin or screw, a cementing plug, a Teleperf plug, a drill in sand control beaded screen plug, a HP beaded frac screen plug, a hold down dog and spring, a seal bore protector, a stimcoat screen protector, or a liner port plug.

9. A downhole assembly comprising the disintegrable article of claim 1 and an electric current source electrically coupled to the disintegrable downhole article.

10. The disintegrable downhole article of claim 1, wherein the outer jacket further comprises about 1 to about 10 wt. % of ruthenium based on the total weight of the outer jacket.

11. The disintegrable article of claim 1, wherein the energetic material is present in an amount of about 0.5 wt. % to about 20 wt. % based on the total weight of the disintegrable article.

12. The disintegrable downhole article of claim 1, wherein the energetic material comprises fibers, wires, ribbons, or a combination comprising at least one of the foregoing.

13. A disintegrable downhole article comprising, an electrolytically degradable metallic matrix comprising Zn, Mg, Al, Mn, an alloy thereof, or a combination comprising at least one of the foregoing; and an energetic material comprising a first metal and a second metal that is in physical contact with the first metal, the first metal and the second metal being selected such that the first metal reacts with the second metal to generate an alloy, an intermetallic compound, or a combination comprising at least one of the foregoing when electrically actuated, wherein the first metal is aluminum or an aluminum alloy, the second metal is palladium or a palladium alloy, and the energetic material has a core of the first metal with an outer jacket of the second metal, wherein the energetic material is present in an amount of about 0.5 wt. % to about 45 wt. % based on the total weight of the disintegrable downhole article and the energetic material is randomly distributed in the electrolytically degradable matrix.

14. A disintegrable downhole article comprising a substantially-continuous, cellular nanomatrix comprising a nanomatrix material;

a plurality of dispersed particles comprising a first metal dispersed in the cellular nanomatrix; and a second metal disposed in the dispersed particles, wherein the first metal and the second metal are in physical contact and are selected such that the first metal reacts with the second metal to generate an alloy, an intermetallic compound, heat, or a combination comprising at least one of the foregoing when electrically actuated;

the first metal is one or more of the following: aluminum, magnesium, an aluminum alloy, or a magnesium alloy; the second metal is one or more of the following: palladium, platinum, a palladium alloy, or a platinum alloy; and the substantially-continuous, cellular nanomatrix comprises Al, Ni, W, Mo, Cu, Fe, Cr, Co, an alloy thereof, or a combination comprising at least one of the foregoing.

15. The disintegrable downhole article of claim 14, wherein the first metal is magnesium, or a magnesium alloy.

16. The disintegrable downhole article of claim 14, wherein the second metal is present in an amount of about 0.5 wt. % to about 45 wt. % based on the total weight of the disintegrable downhole article.

17. A downhole assembly comprising the disintegrable downhole article of claim 14 and an electric current source electrically coupled to the disintegrable downhole article.

18. The disintegrable downhole article of claim 14, wherein the disintegrable downhole article further comprises a plurality of aluminum or aluminum alloy particles dispersed in the substantially-continuous cellular nanomatrix.

19. The disintegrable article of claim 18, wherein the disintegrable downhole article further comprises palladium, platinum, or a combination thereof dispersed in the aluminum or aluminum alloy particles.

20. A method of controllably removing a disintegrable downhole article, the method comprising:

disposing the downhole article in a downhole environment, the downhole article including an electrolytically degradable metallic matrix and an energetic material comprising a first metal and a second metal that is in physical contact with the first metal, the first metal and the second metal being selected such that the first metal reacts with the second metal to generate an alloy, an intermetallic compound, heat, or a combination comprising at least one of the foregoing when electrically actuated;

performing a downhole operation;

electrically actuating a reaction between the first metal and the second metal; and disintegrating the downhole article, wherein the first metal is aluminum or an aluminum alloy, the second metal is palladium or a palladium alloy, and the energetic material has a core of the first metal with an outer jacket of the second metal.

21. The method of claim 20, wherein electrically actuating a reaction between the first metal and the second metal comprises applying an electrical current to the first metal and the second metal.

22. The method of claim 20, wherein the first metal is one or more of the following: aluminum, magnesium, an aluminum alloy, or a magnesium alloy; and the second metal is one or more of the following: palladium, platinum, a palladium alloy, or a platinum alloy.

23. A method of controllably removing a disintegrable downhole article, the method comprising:

disposing the downhole article in a downhole environment, the downhole article including a substantially-continuous, cellular nanomatrix comprising a nanomatrix material; a plurality of dispersed particles comprising a first metal dispersed in the cellular nanomatrix; and a second metal disposed in the cellular nanomatrix, wherein the first metal and the second metal are in physical contact and are selected such that the first metal reacts with the second metal to generate an alloy, an intermetallic compound, heat, or a combination comprising at least one of the foregoing when electrically actuated;

performing a downhole operation;

electrically actuating a reaction between the first metal and the second metal; and disintegrating the downhole article, the first metal is one or more of the following: magnesium or an aluminum alloy;

and the second metal is one or more of the following: palladium, platinum, a palladium alloy, or a platinum alloy; and the substantially-continuous, cellular nanomatrix comprises (1) Al and (2) Pd, Pt, or a combination thereof, wherein (1) Al is in physical contact with (2) Pd, Pt, or a combination thereof.

24. The method of claim 23, wherein electrically actuating a reaction between the first metal and the second metal comprises applying an electrical current to the first metal and the second metal.

25. The method of claim 23, wherein the first metal is magnesium or a magnesium alloy.

* * * * *